US006821160B2

(12) United States Patent
Fink et al.

(10) Patent No.: US 6,821,160 B2
(45) Date of Patent: Nov. 23, 2004

(54) HIGH VOLTAGE ELECTRICAL CONNECTION

(75) Inventors: Randy L. Fink, Warren, OH (US); William L. Stein, Sr., Warren, OH (US); James W. Albrecht, Solon, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/404,805

(22) Filed: Apr. 1, 2003

(65) Prior Publication Data

US 2004/0198100 A1 Oct. 7, 2004

(51) Int. Cl.[7] ..... H01R 13/502

(52) U.S. Cl. ..... 439/701; 439/595

(58) Field of Search ..... 439/701, 607–610, 439/594–599, 752, 352, 357, 851, 842, 816, 877–878, 787

(56) References Cited

U.S. PATENT DOCUMENTS

| | | | | | |
|---|---|---|---|---|---|
| 4,449,778 | A | * | 5/1984 | Lane | 439/610 |
| 5,181,862 | A | * | 1/1993 | Hawk et al. | 439/595 |
| 5,222,909 | A | * | 6/1993 | Nomura et al. | 439/607 |
| 5,252,092 | A | * | 10/1993 | Reider et al. | 439/595 |
| 5,518,421 | A | * | 5/1996 | Davis | 439/607 |
| 5,584,727 | A | * | 12/1996 | Miller et al. | 439/607 |
| 5,897,404 | A | * | 4/1999 | Goodman et al. | 439/843 |
| 6,365,297 | B1 | | 4/2002 | Wolczak et al. | |
| 6,368,451 | B1 | | 4/2002 | Goulette et al. | |
| 6,656,002 | B2 | * | 12/2003 | Zhao et al. | 439/851 |

* cited by examiner

*Primary Examiner*—Tho D. Ta
*Assistant Examiner*—Edwin A. Leon
(74) *Attorney, Agent, or Firm*—David P. Wood

(57) ABSTRACT

A high voltage electrical connection includes an electrical receptacle connector and a mating electrical plug connector. The electrical receptacle connector includes a receptacle that is mounted over a hole in the casing and fastened thereto with a plurality of terminated electrical leads that are attached to an internal component of an electrical device inside the casing and threaded through a hole in the casing. The receptacle has a chamber including an inlet at one end that is aligned with the hole in casing and an outlet at the other end. The electrical receptacle connector also includes a terminal holder and a terminal housing, both of which are made of electrical insulation material. The holder retains the plurality of terminals, of the respective leads is inserted into the chamber through the outlet of the receptacle and retained in the chamber. The terminal housing is then inserted into the chamber via the outlet with its flange being disposed in the outlet. The flange has a plurality of spaced holes, each one of which receives one of the plurality of terminals. Flange includes a stop to locate the terminal housing with respect to the receptacle in a longitudinal direction of the terminals, and an integral shroud that extends outwardly of the outlet whereby the electrical receptacle connector is adapted to receive the mating plug connector. The mating electrical plug connector which includes a plurality of terminals each attached to one of a plurality of electrical leads, a connector body housing the plurality of terminals, a terminal position assurance (TPA)/wire dress feature for the plurality of terminals and electrical leads, and an, electromagnetic interference (EMI) shield.

27 Claims, 8 Drawing Sheets

HIGH VOLTAGE ELECTRICAL CONNECTION

FIELD OF THE INVENTION

This invention relates to electrical connectors and more particularly to high power electrical connection for an electrical induction device.

BACKGROUND OF THE INVENTION

An electrical induction device, such as an electric transmission requires a high voltage electrical connection on the order of 220 volts. The electric transmission which is a three phase induction machine controlled through electronic switching is fabricated with three electrical leads that are connected to an internal stator and lead out of a hole in the casing for connection to an external power source. Presently, pass through adapters and grommets are used to seal the hole in the casing.

SUMMARY OF THE INVENTION

The present invention provides an electrical connection system for electrical leads that pass through a hole in a casing that seals the hole without any need for a pass through adapter or a grommet.

In one aspect, the invention provides a high voltage electrical receptacle connector that can be assembled outside of a casing using a plurality of short electric leads sticking out of a hole in the casing. The electrical receptacle connector is then attached to the casing to seal the hole in the casing. The electrical leads are preferably as short as possible to minimize lead feed back into the casing while being of sufficient length to be made part of the electrical receptacle connector that is assembled outside the casing so that the electrical leads can be connected to an external power source.

In another aspect, the invention provides a mating high voltage electrical plug connector for the receptacle connector that is assembled outside of the casing.

In still another aspect, the invention provides a high voltage terminal for the high voltage electrical plug connector.

DETAILED DESCRIPTION OF PREFERRED EMBODIMENTS

Figure 1:
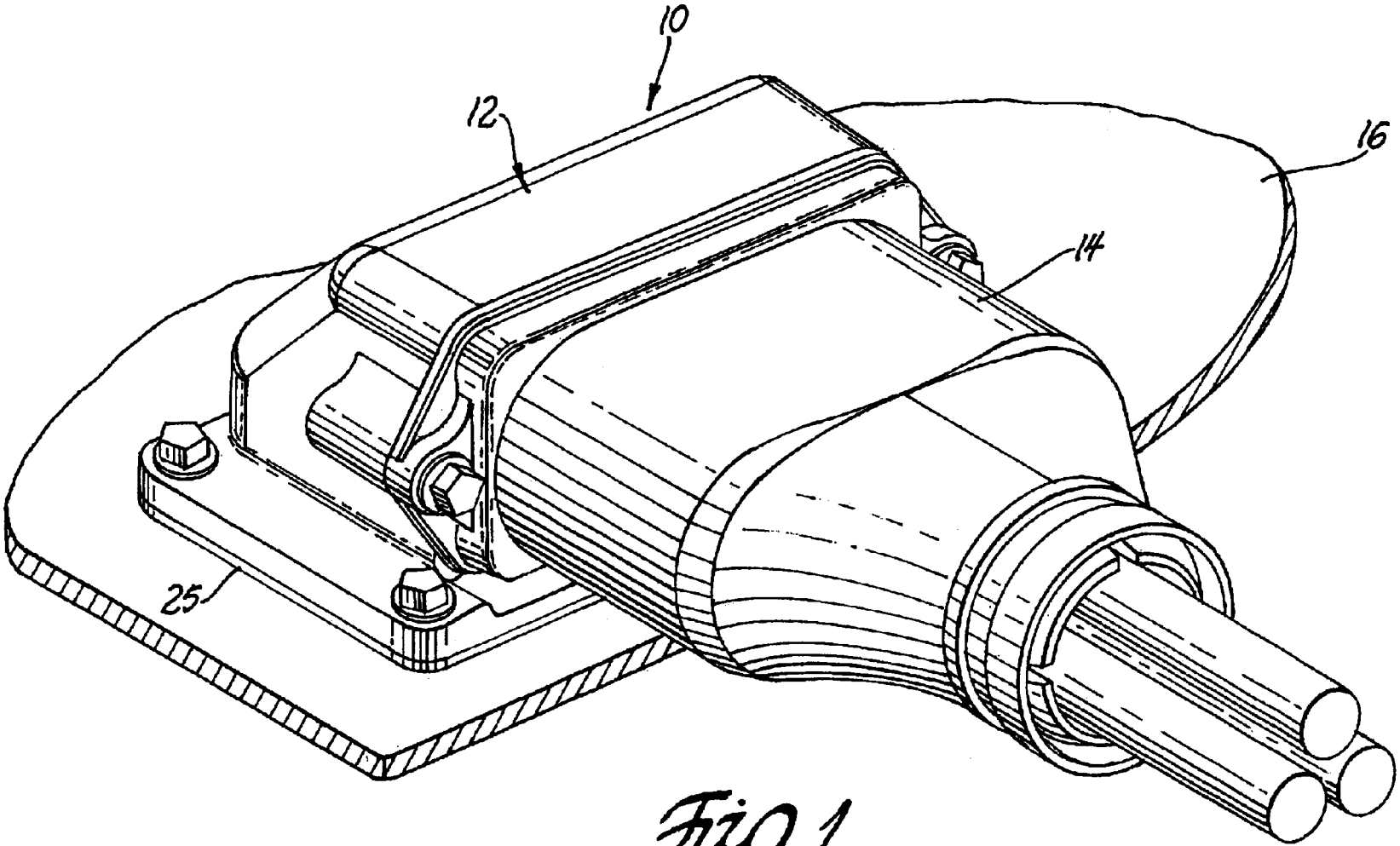
FIG. 1 is a perspective view of a high power electrical connection in accordance with the invention.

Referring now to the drawings, FIG. 1 shows a high voltage electrical connection 10 of the invention comprising an electrical receptacle connector 12 and a mating electrical plug connector 14. The electrical receptacle connector 12 which is attached to a motor casing 16 is shown in detail in FIGS. 2 through 6.

Figure 2:
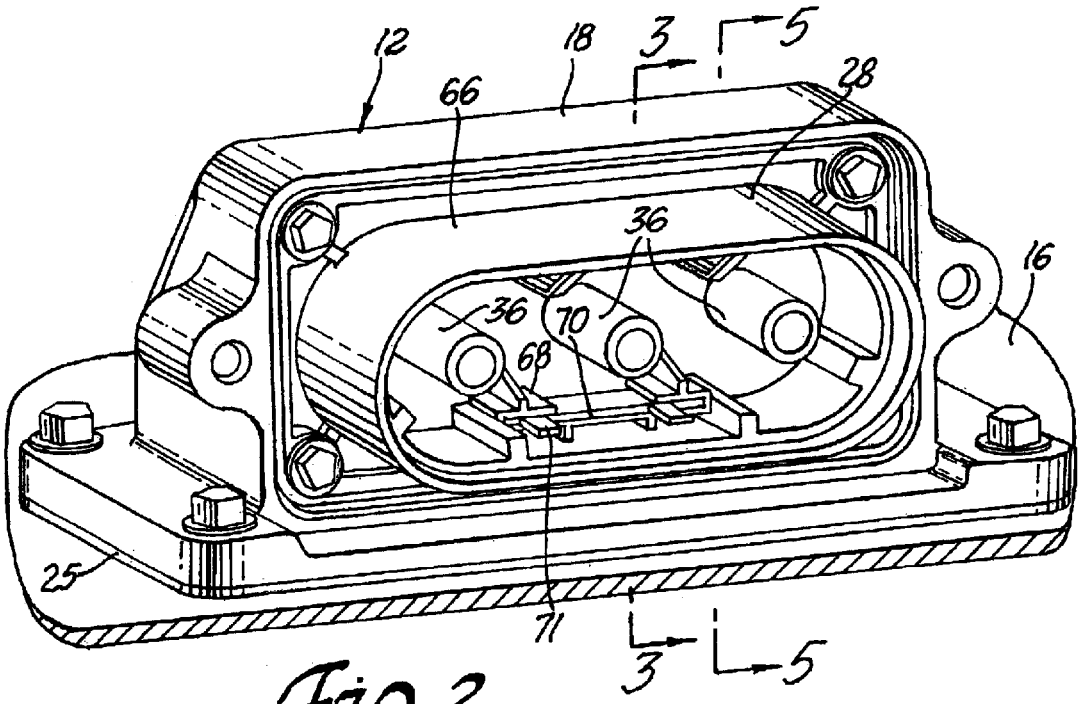
FIG. 2 is a perspective view of the electrical receptacle-connector that is part of the electrical connection shown in FIG. 1.
Figure 3:
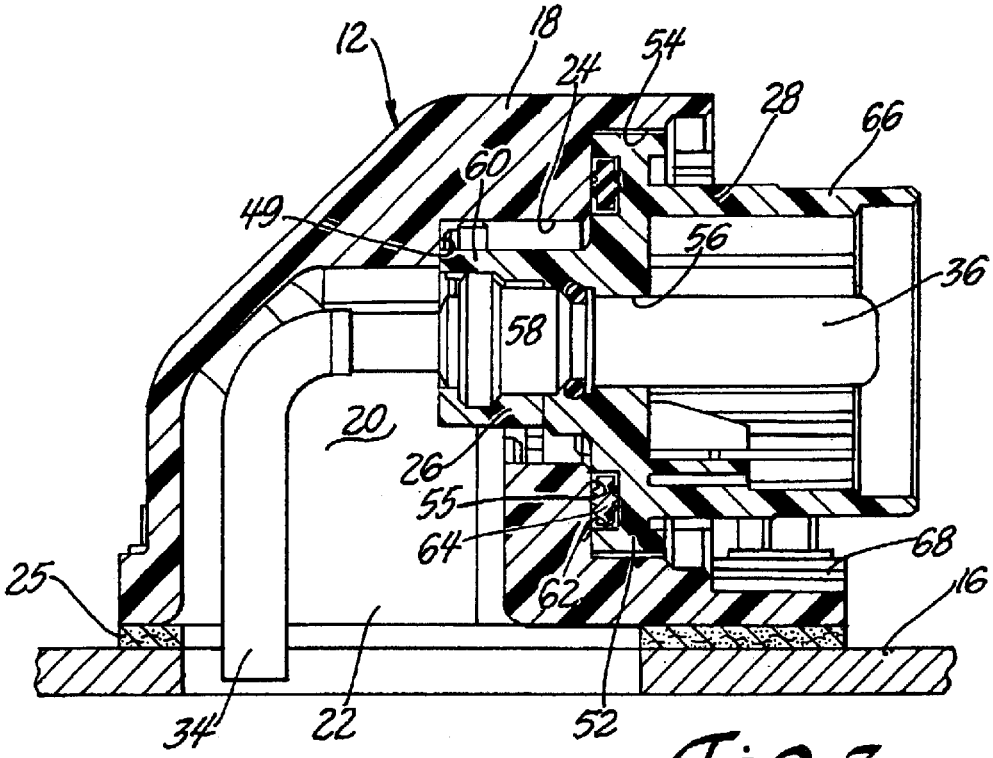
FIG. 3 is a cross section of the electrical receptacle connector taken substantially along the line 3—3 of FIG. 2 looking in the direction of the arrows.

Referring now to FIGS. 2 and 3, the electrical receptacle connector 12 comprises a right angled metal receptacle 18 that is mounted over the hole in the casing 16 and fastened to the motor casing 16 with bolts or the like. Receptacle connector 12 has an internal chamber 20 including an inlet 22 at one end that is aligned with the hole in casing 16 and a stepped outlet 24 that is perpendicular to the inlet. A compression gasket (25) is disposed between the receptacle 18 and the motor casing 16 to seal the interface between receptacle 18 and motor casing 16.

Receptacle connector 12 further comprises a terminal holder 26 and a terminal; housing 28, both of which are made of thermoplastic or other suitable electrical insulation material. Holder 26 is used in assembling receptacle connector 12 outside of casing 16 as explained below.

Figure 4:
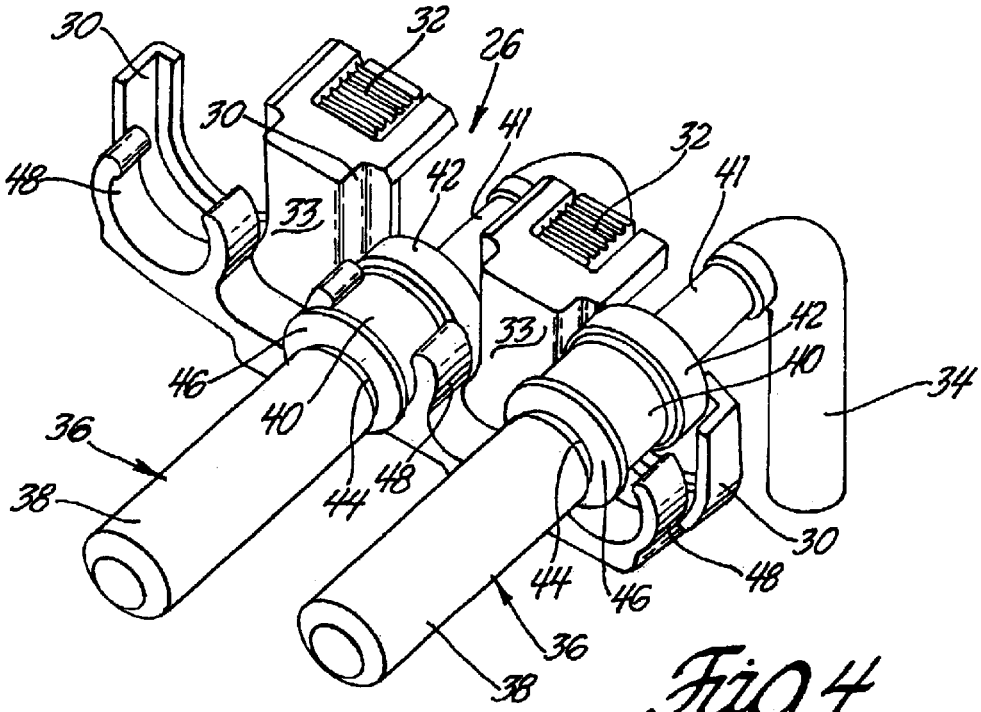
FIG. 4 is a perspective view of a subassembly of the electrical receptacle connector that is shown in FIG. 2.
Figure 5:
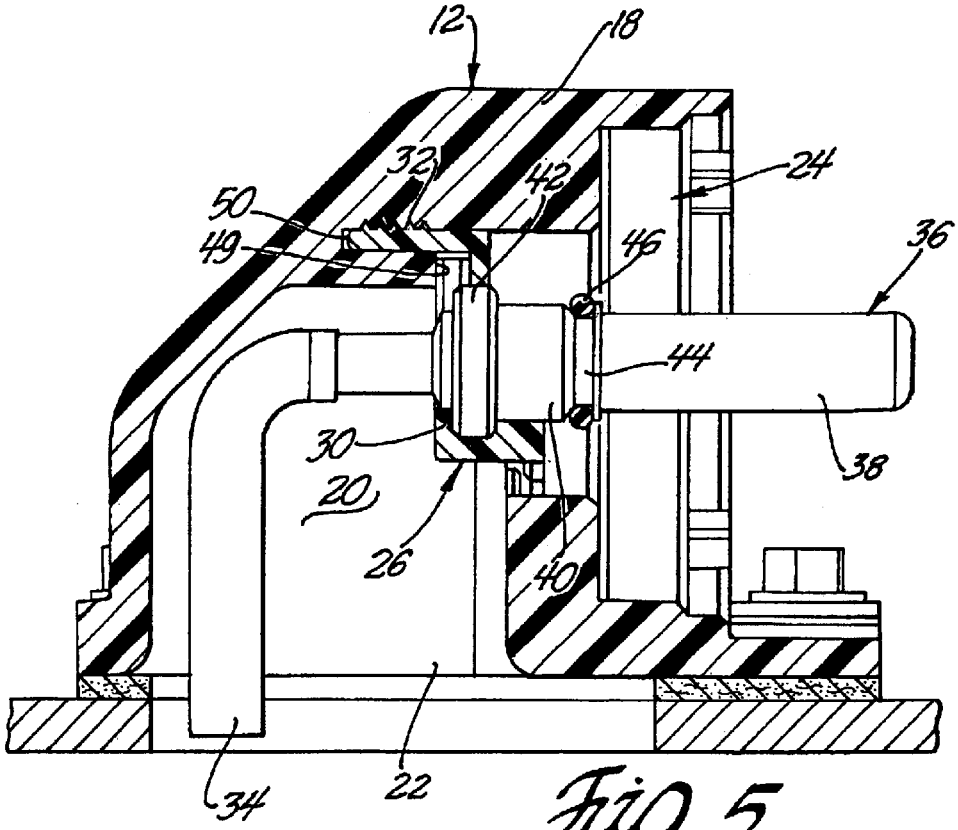
FIG. 5 is a cross section of the electrical receptacle connector taken substantially along the line 5—5 of FIG. 2 looking in the direction of the arrows with the terminal housing removed for clarity.

Referring now to FIGS. 4 and 5, terminal holder 26 comprises a plurality of laterally spaced terminal retainers 30 and a plurality of press tabs 32. Each press tab 32 is located at the top of a pedestal 33 that is disposed between a pair of terminal retainers 30 as best shown in FIG. 4. Electrical leads 34 are attached to an internal component of the electrical device inside casing 16 (such as the stator of an electric transmission) and threaded through the hole. Electrical leads 34 are preferably terminated before attachment to the internal component.

In either event, the electrical leads 34 are terminated with barrel type terminals 36 that have a barrel shaped contact 38 at one end and an opposite end 40 that is attached to the lead core 41 at an insulation stripped end of the electric lead 34, usually by a crimping operation. The opposite or attachment end 40 also includes an end collar 42 and an annular recess 44. Annular recess 44 which is spaced inwardly of the end collar 42 toward the contact 38 receives an elastomeric O-ring seal 46.

Each terminal 36 is held in one of the terminal retainers 30 by a clip 48 of holder 26 with the end collar 42 of each terminal 36 cooperating with its associated clip 48 and retainer 30 for axial retention of the terminal 36 as best shown by the terminal 36 in the middle retainer 30 in FIG. 4.

FIG. 4 shows a open retainer 30 at the left, a retained terminal 36 in the middle retainer 30 and a terminal 36 being inserted into the retainer 30 at the right. When three terminals 36 are retained in holder 26, holder 26 is pushed through stepped outlet 24 of chamber 20 into receptacle 18 until holder 26 engages shoulder 49 and press tabs 32 engage in retention slots 50 to retain the holder 26 in receptacle 18 as best shown in FIG. 5. The use of holder 26 and above assembly procedure minimizes the extra length of leads 34 that must be fed back into casing 16 because the leads 34 extend beyond their assembled position shown in FIG. 5 only a short distance (about 10 mm) for assembly into holder 24. Terminals 36 are preferably male pin terminals.

Figure 6:
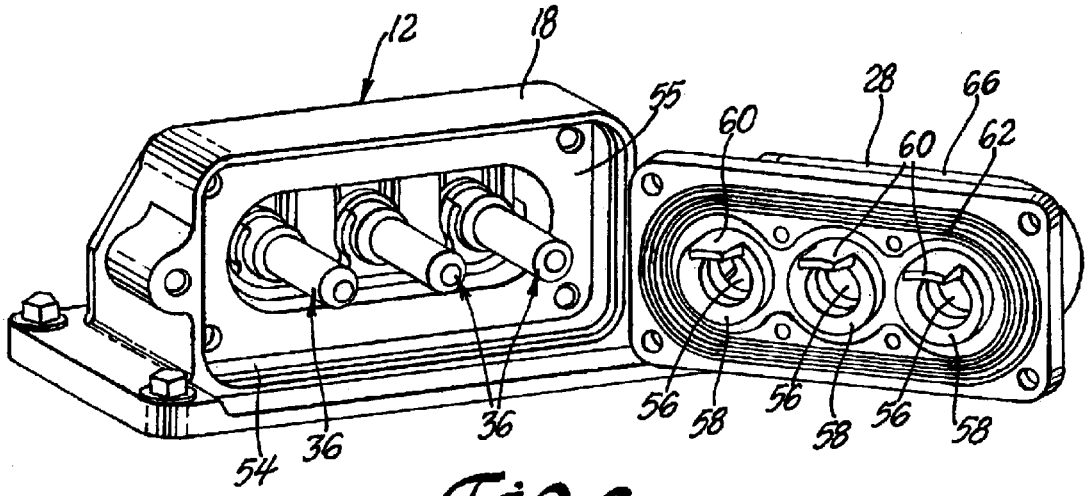
FIG. 6 is an exploded perspective view of the electrical receptacle connector shown in FIG. 2.

Referring now to FIGS. 2, 3 and 6, the terminal housing 28 comprises a flange 52 that fits in the intermediate part 54 of the three part stepped outlet 24 of chamber 20 in receptacle 18 against a back wall 55. Flange 52 has a plurality of spaced holes 56 extending through the flange, each hole 56 receiving one of the terminals 36. An integral terminal collar 58 extends from the inner side of flange 52 for each hole 56 as best shown in FIGS. 3 and 6. The terminal collar 58 cooperates with the O-ring seal 46 of the associated terminal 36 to seal the passage through the hole 56 as best shown in FIG. 3. Each terminal collar 58 includes a stop tab 60 that extends through a space in holder 26 and engages the shoulder 49 of receptacle 18 to locate the terminal housing 28 with respect to the receptacle 18 in the longitudinal direction of the terminals 36. The inner side of flange 52 includes an oval shaped groove 62 that receives an oval shaped face seal 64 that engages the back wall 55 of the receptacle 18 to seal the interface between the terminal housing 28 and the receptacle 18 as best shown in FIGS. 3 and 6. The face seal 64 is compressed when flange 52 is bolted to receptacle 18 by bolts that extend through flange 52 outwardly of face seal 64 as shown in FIG. 3.

Figure 10:
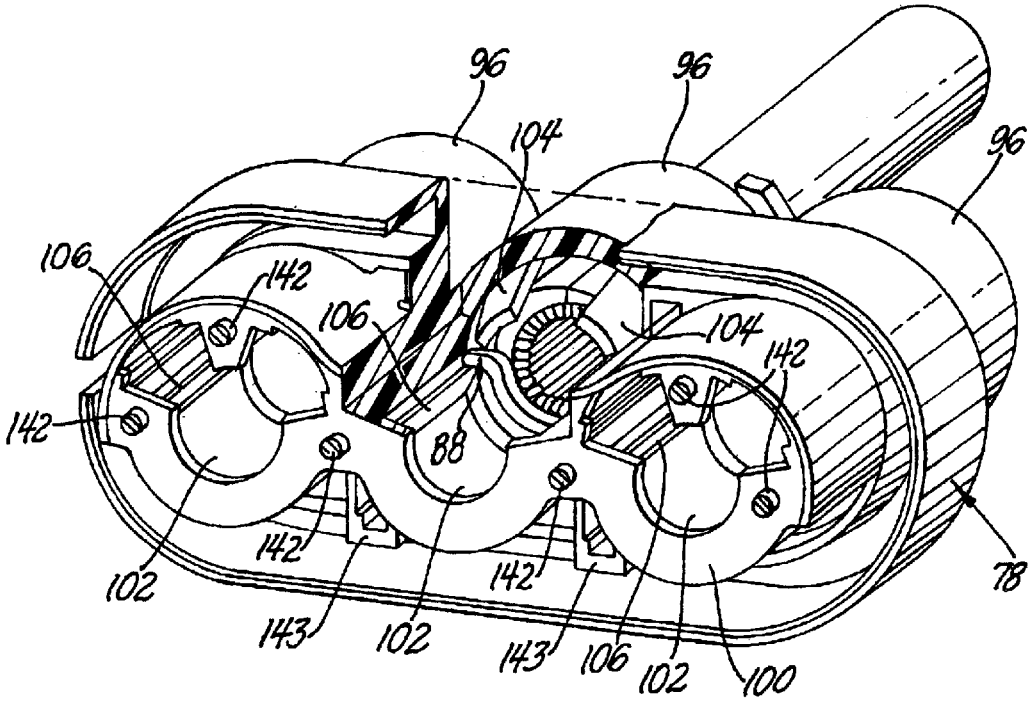
FIG. 10 is an exploded perspective sectioned view of the electrical plug connector shown in FIGS. 7 and 8.
Figure 13:
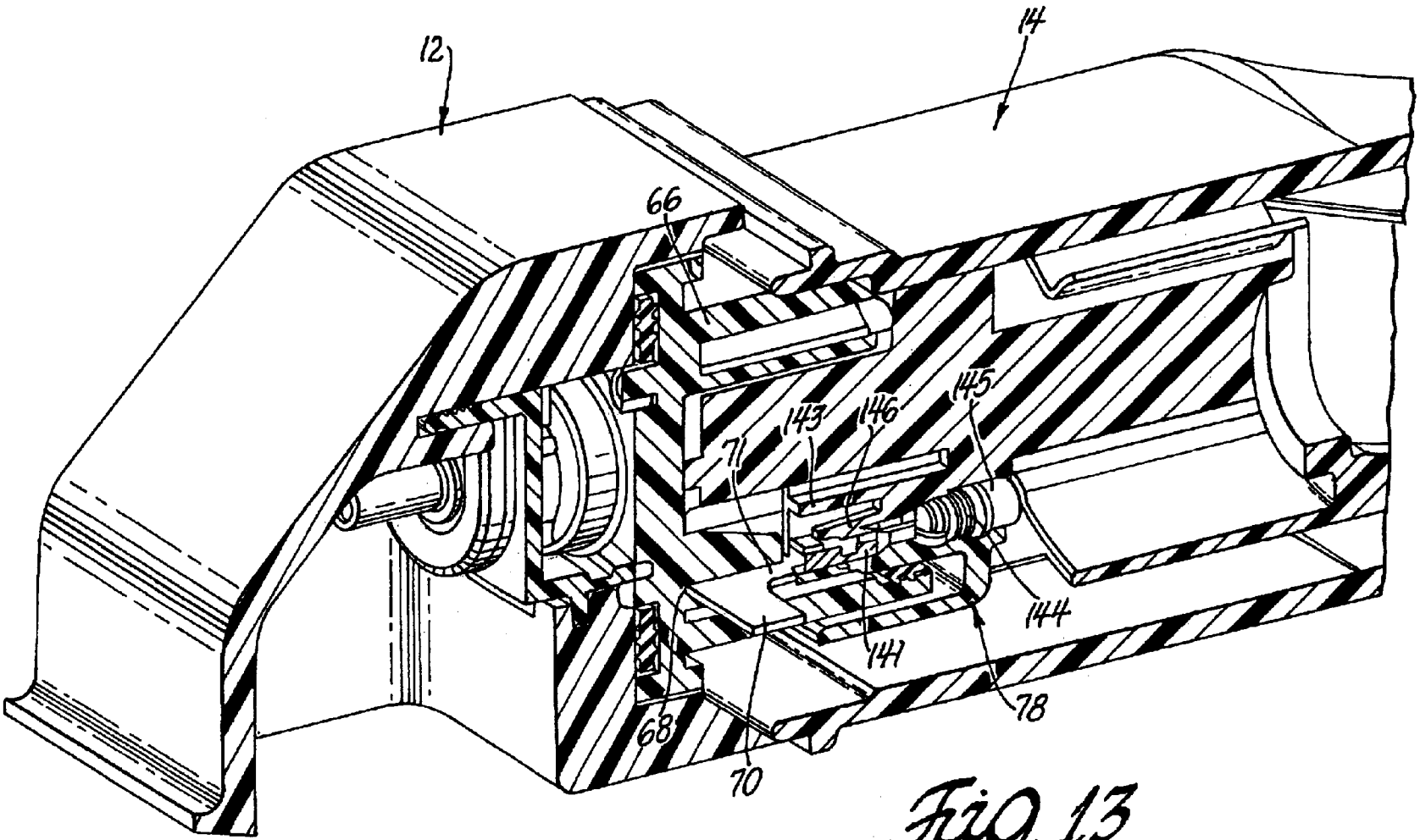
FIG. 13 is a perspective section of the high power electrical connection of FIG. 1 showing details of an interruption link and mating connectors.

The outer side of flange 52 has an integral shroud 66 as shown in FIGS. 2 and 3. The inside of shroud 66 is shaped to receive electrical plug connector 14 as explained below. Shroud 66 includes a pair of laterally spaced slots 68 that hold for a flat metal electrical interruption link 70 that is best shown in FIG. 13. The flat metal link 70 has two extended electrical arms 71. Mating plug connector 14 houses two female terminals 14, which are locked in laterally spaced terminal housings 143 of connector body 78 via flexible arms 146 as best shown in FIGS. 10 and 13. The female terminals 141 have an environmental seal 144 crimped to the terminal and the electrical lead. A terminal position feature 145 prevents female terminals 141 from backing out of connector body 78.

Female terminals 141 engage the respective electrical arms 71 of flat metal link 70 when the electrical receptacle connector 12 and the electrical plug connector 14 are mated to form the high voltage electrical connection 10. This drains off residual voltage stored within the high voltage connection 10 during use and thus eliminates the possibility of an electrical discharge when the electrical plug connector 14 is unplugged.

Details of the electrical plug connector 14 of FIG. 1 are shown in FIGS. 7 through 12.

Figure 7:
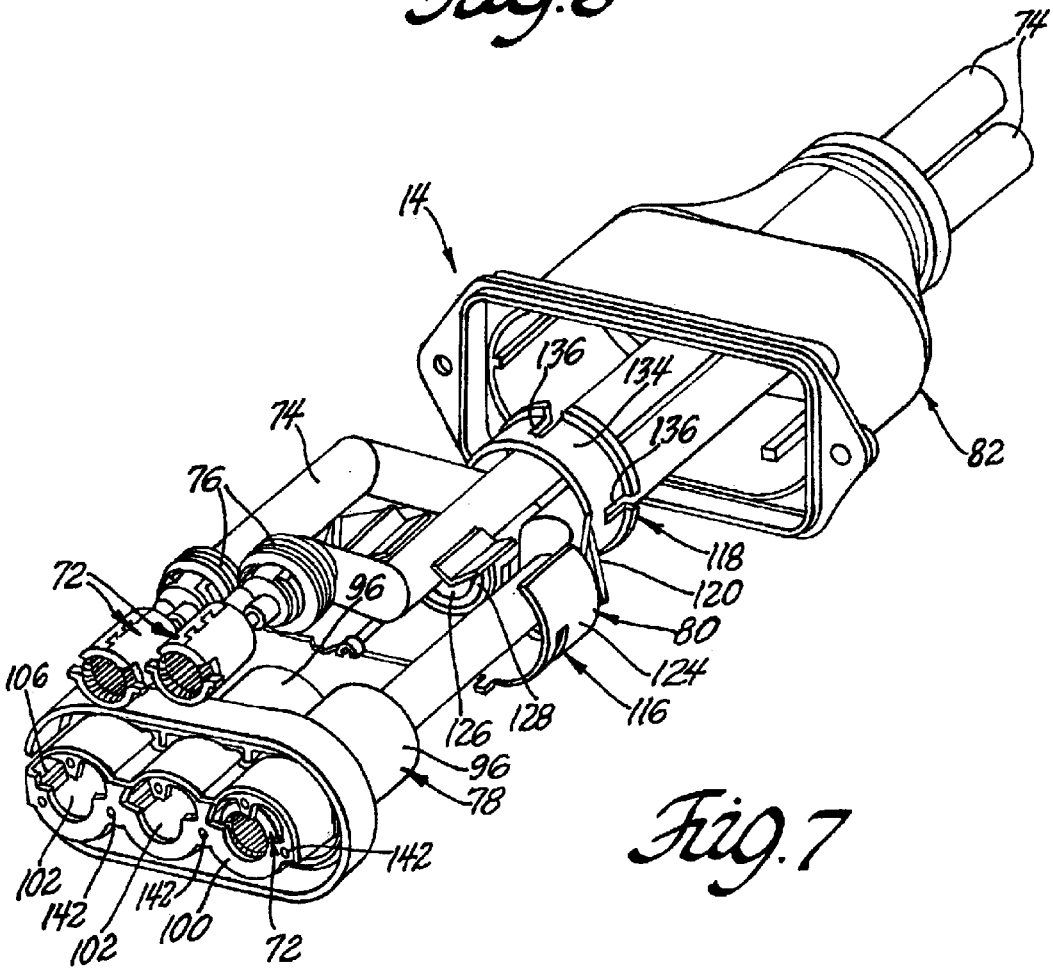
FIG. 7 is an exploded perspective view of the electrical plug connector that is shown in FIG. 1.
Figure 8:
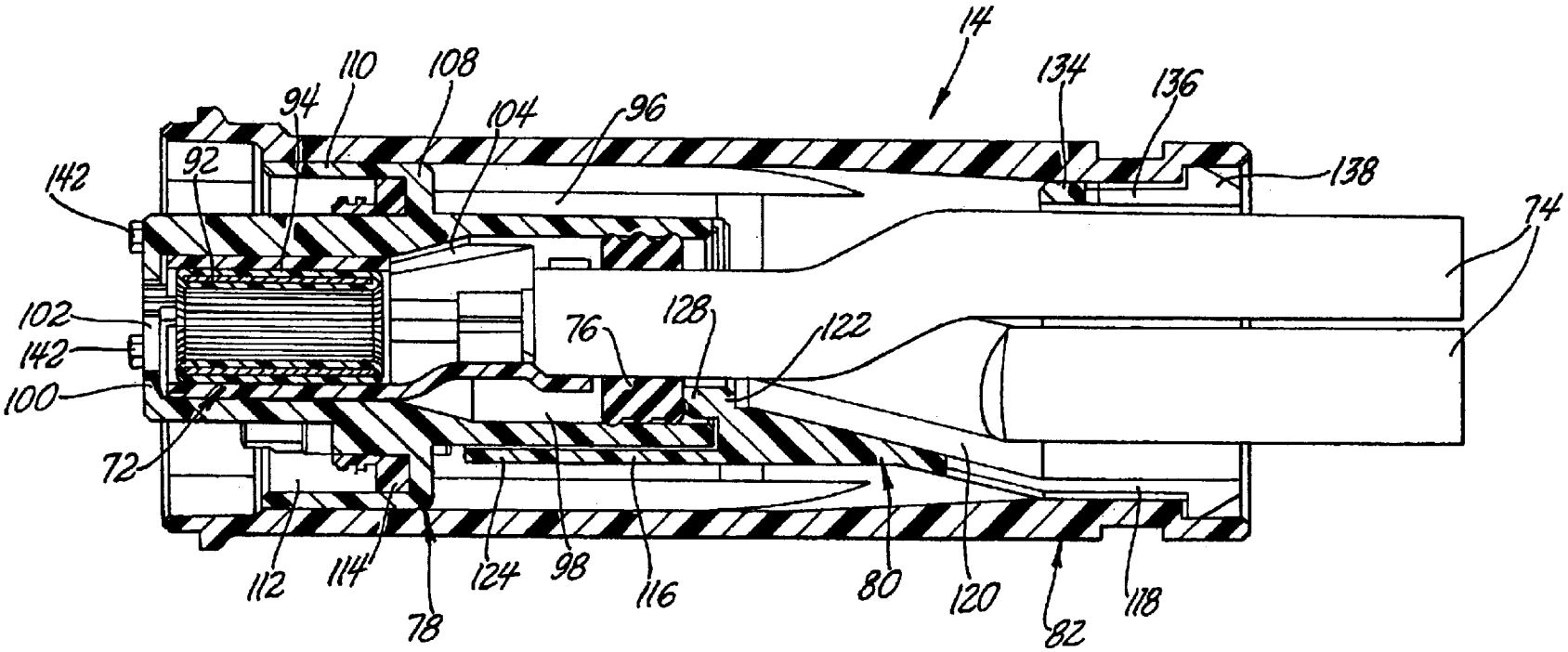
FIG. 8 is a cross section of the electrical plug connector taken substantially along the line 8—8 of FIG. 7 looking in the direction of the arrows.

Referring now to FIGS. 7 and 8, the electrical plug connector 14 comprises a plurality of terminals 72 each attached to an electrical lead 74 and holding a cable seal 76. The electrical connector 14 includes a connector body 78 housing terminals 72, a terminal position assurance (TPA)/wire dress feature 80 for terminals 72 and electrical leads 74 and an electromagnetic interference (EMI) shield 82.

Figure 9:
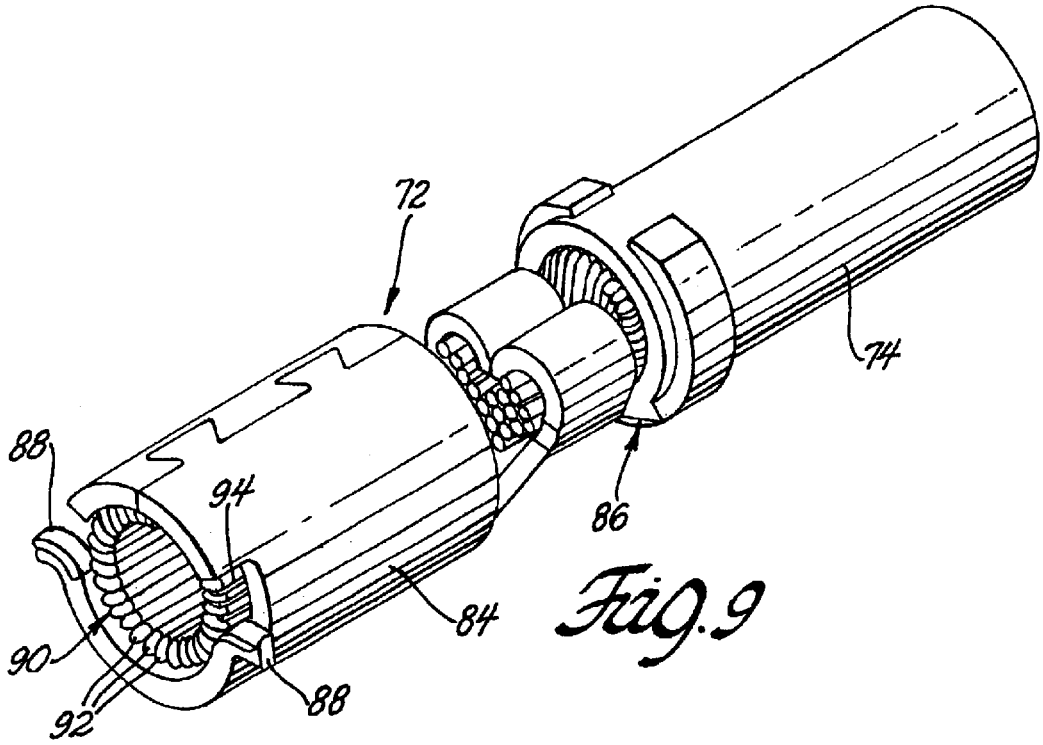
FIG. 9 is a perspective view of one of the terminals of the electrical plug connector that is shown in FIG. 7.

A typical terminal 72 is shown in FIG. 9. It comprises a contact barrel 84 at one end and an attachment portion 86 at the opposite end. Attachment portion 86 comprises convention core and insulation crimp wings that are crimped onto the insulation stripped core end and adjacent insulation jacket of electrical lead 74 in a conventional manner. Contact barrel 84 is a split barrel with the seam of the barrel being formed by dove-tailed or interlocking tabs and slots to guard against the split barrel opening up after prolonged use. The front of contact barrel 84 has two diametrically opposed wings 88 that extend outwardly of the contact barrel. Terminals 72 are preferably female terminals and preferably also include a female contact insert 90 that comprises a plurality of resilient contact wires 92 inside a support sleeve 94 with the ends of the resilient contact wires 92 wrapped around the ends of the support sleeve 94 as best shown in FIGS. 8 and 9 and slightly bowed inwardly away from the support sleeve 94 between the ends of the support sleeve 94.

Referring now to FIGS. 7, 8 and 10, connector body 78 comprises a plurality of cylindrical portions 96 arrayed side by side with their abutting side walls integrally joined together. Each cylindrical portion 96 forms a cylindrical terminal cavity 98; which receives a terminal 72 attached to one of the electrical leads 74 as best shown in FIG. 8. Each terminal cavity 98 has a partial front wall 100 defining a tri-lobal opening 102 at the contact end as best shown in FIGS. 7 and 10. Tri-lobal opening 102 has a central or concentric lobe to provide access to the female terminal 72 and two eccentric lobes which facilitate the molding of two resilient, cantilevered, retention fingers 104 inside the cylindrical terminal cavity 98 that are integrally attached to the side wall of the enlarged rearward portion of each terminal cavity as best shown in FIGS. 8 and 10. The reduced forward portion of each terminal cavity 98 has diametrically opposed guide slots 106 for receiving the terminal wings 88.

Terminals 72 are loaded into the terminal cavities 98 from the conductor or lead end. During the loading process, retention fingers 104 are pushed outwardly by contact barrels 84 as contact barrels enter the reduced forward portions oriented and guided by terminal wings 88 entering guide slots 106 as best shown in FIG. 10. Retention fingers 104 are held outwardly until the terminals 72 are fully inserted into the terminal cavities 98 whereupon the retention fingers snap down behind the contact barrels 84 to retain the contact barrels between the retention fingers 104 and the partial front walls 100 as best shown in FIG. 8.

Connector body 78 also includes a medial flange 108 that supports an annular hood 110 that extends toward the forward contact end of the connector body 78 to form an annular groove 112. Groove 112 receives the shroud 66 of the receptacle connector 12 when the plug connector 14 is mated to the receptacle connector 12. An annular elastomeric seal 114 is disposed at the inner closed end of the annular groove 112 to seal the interface between the plug connector 14 and the receptacle connector 12.

After the terminals 72 are loaded into the terminal cavities 98, cable seals 76 are slid onto each electrical lead 74 into a position behind the associated terminal 72. The TPA/wire dress 80 which is pre-positioned around the electrical wires 74 as shown in FIG. 7 is then assembled to the connector body 78 as shown in FIG. 8.

Figure 11:
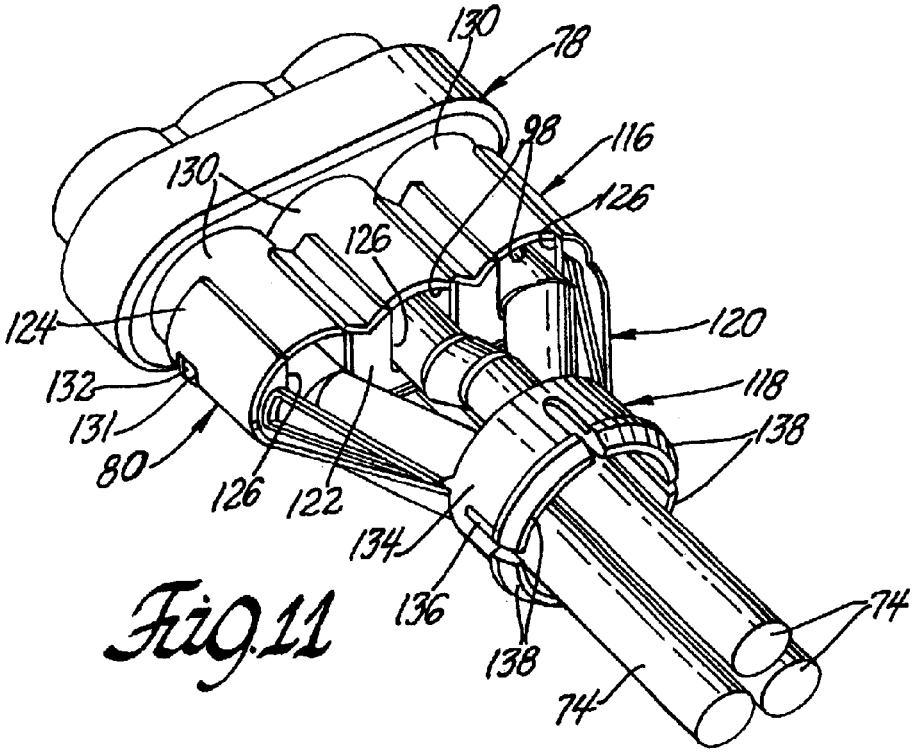
FIG. 11 is a perspective rear view of the electrical plug connector that is shown in FIG. 7.

Referring now to FIGS. 7, 8 and 11, the TPA/wire dress 80 comprises a forward TPA portion 116 and a rearward wire dress portion 118 connected together by a transition 120. The TPA portion 116 includes an end wall 122 and a forward, projecting hood 124 that is sized and shaped to fit over the rearward end of connector body 78. End wall 122 has a plurality of lead slots 126 with integral forward projecting collars 128 that align with the terminal cavities 98 respectively. Hood 124 has a plurality of loading slots 130 that align with lead slots 126 respectively and two retention slots 132 as best shown in FIG. 11.

The top of transition 120 is open while the rearward dress portion 118 is a closed collar 134 as shown in FIGS. 7 and 11. Collar 134 has a plurality of longitudinal slots 136 that are open at the rear or conductor end which includes a flange 138 that is divided into a number of segments by the slots 136. Slots 136 increase the flexibility of the conductor end portion of collar 134 so that the flange segments can be depressed radially inwardly The TPA/wire dress 80 which as stated above, is pre-positioned around the electrical leads 74 so that the electrical leads 74 extend through collar 134 as shown in FIG. 7. The electrical leads 74 are then loaded into the lead slots 126, respectively, via loading slots 130. The TPA/wire dress 80 is then slid forward so that the projecting hood 124 slides onto the rearward portion of the connector body 78 until the hood 124 is locked in place by lock tabs 131 engaging in retention slots 132 as best shown in FIG. 11. When hood 124 is locked in place, the forward projecting collars 128 of end wall 122 project into the ends of the terminal cavities 98 and engage the cable seals 76 as best shown in FIG. 8, thus assuring that the cable seals 76 as well as the terminals 72 are properly located in the terminal cavities 98.

Figure 12:
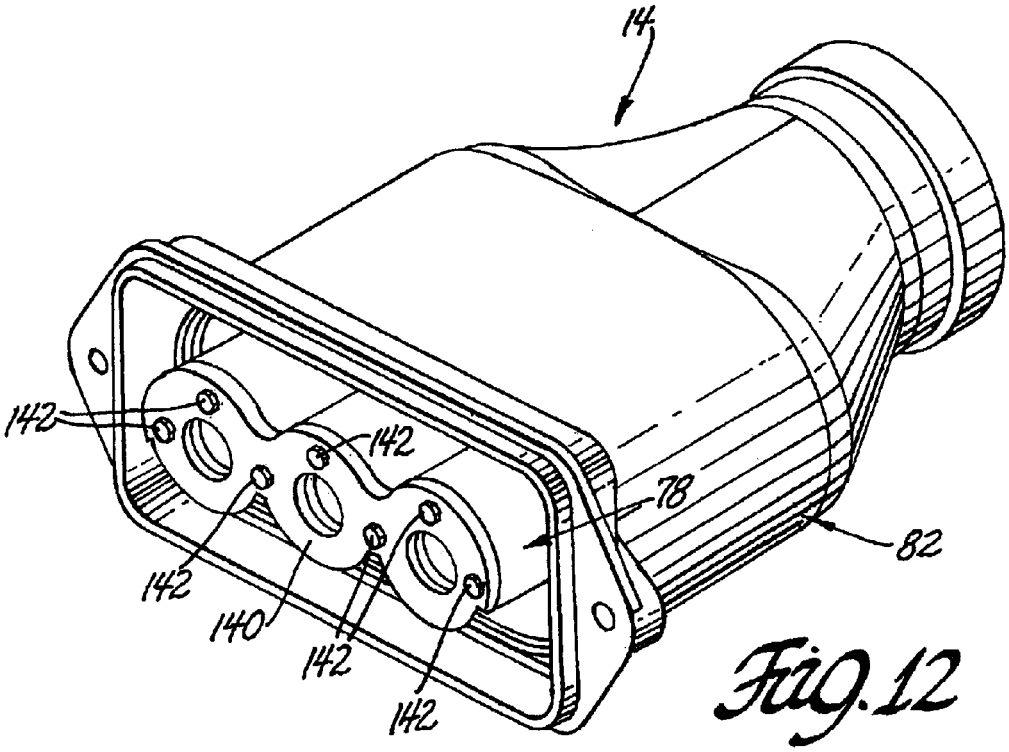
FIG. 12 is a perspective front view of the electrical plug connector that is shown in FIG. 7.

After the TPA/wire dress 80 is secured in place, the EMI shield 82 which is also pre-positioned around the electrical wires 74 as shown in FIG. 7, is then slid forward over the collar 134 into place over the annular hood 110 of the connector body 78 as shown in FIGS. 8 and 12. A tri-annular gasket 140 is then attached to the front wall 100 of the connector body 78 using the integral studs 142 of the front wall which are headed over to keep the face seal 140 in place as shown in FIG. 12.

The electrical plug connector 14 is then plugged into the electrical receptacle connector 12 and held in place by two bolts as shown in FIG. 1.

The foregoing description discloses and describes various aspects and embodiments of the present invention. One skilled in the art will readily recognize from such description, and from the accompanying drawings and claims, that various changes, modifications and variations can be made therein without departing from the spirit and scope of the present invention, and also such modifications, changes and variations are intended to be included within the scope of the following claims.

We claim:

1. An electrical plug connector for a plurality of electrical leads comprising:

a plurality of terminals each attached to one of the plurality of electrical leads, a connector body housing the plurality of terminals, a terminal position assurance(TPA)/wire dress feature for the plurality of terminals and electrical leads, and an electromagnetic interference (EMI) shield, wherein the connector body comprises a plurality of cylindrical portions, each cylindrical portion forming a cylindrical terminal cavity which receives one of the plurality of terminals attached to one of the plurality of electrical leads, wherein the TPA/wire dress feature comprises a forward TPA portion that includes an end wall that has a plurality of lead slots with internal forward projecting collars that align with the terminal cavities respectively.

2. The electrical plug connector as defined in claim 1 wherein the TPA/wire dress feature comprises a rearward wire dress portion.

3. The electrical plug connector as defined in claim 1 wherein each of the terminals comprises a contact barrel at one end and an attachment portion at the opposite end, the contact barrel being a split barrel with the seam of the barrel being formed by interlocking tabs and slots to guard against the barrel seam opening up after prolonged use, the front of contact barrel having two diametrically opposed wings 88 that extend outwardly of the contact barrel.

4. The electrical plug connector as defined in claim 3 wherein each of the terminals is a female terminal that includes a female contact insert that comprises a plurality of contact wires inside a support sleeve with the ends of the contact wires wrapped around the ends of the support sleeve.

5. The electrical plug connector as defined in claim 1 wherein the plurality of cylindrical portions are arrayed side by side with their abutting side walls integrally joined together, each terminal cavity having a partial front wall defining a tri-lobal opening that includes a concentric lobe to provide access to the terminal and two eccentric lobes which facilitate the molding of two resilient, cantilevered, retention fingers inside the cylindrical terminal cavity that are integrally attached to the side wall of an enlarged rearward portion of each terminal cavity, the reduced forward portion of each terminal cavity having diametrically opposed guide slots for receiving the terminal wings, the retention fingers being pushed outwardly by contact barrels as contact barrels enter reduced forward portions the respective terminal cavities oriented and guided by terminal wings entering the guide slots and snapping down behind the contact barrels when the contact barrels are fully inserted to retain the contact barrels between the retention fingers and the partial front walls.

6. The electrical plug connector as defined in claim 5 wherein the connector body also includes a medial flange that supports an annular hood that extends toward the forward contact end of the connector body to form an annular groove for receiving a shroud of a matable receptacle connector when the plug connector is mated to the receptacle connector and wherein an annular elastomeric seal is disposed at the end of the annular groove to seal the interface between the plug connector and the receptacle connector.

7. The electrical plug connector as defined in claim 6 wherein a cable seal at disposed on each lead in a position behind the terminal.

8. The electrical plug connector as defined in claim 7 further including a TPA/wire dress feature which comprises a forward TPA portion and a rearward wire dress portion connected together by a transition, the TPA portion including an end wall and a forward projecting hood that fits over the rearward end of the connector body, the end wall having a plurality of lead slots with integral forward projecting collars that align with the terminal cavities respectively, the hood having a plurality of loading slots that align with lead slots respectively and retention slots, the top of transition being open while the rearward dress portion is a closed collar.

9. The electrical plug connector as defined in claim 8 wherein the collar has a plurality of longitudinal slots that are open at the rear or conductor end which includes a flange that is divided into a number of segments by the slots that increase the flexibility of the conductor end portion of collar so that the flange segments can be depressed radially inwardly, the electrical leads extending through collar and disposed in the lead slots, respectively, the projecting hood being disposed on the rearward portion of the connector body and locked in place by lock tabs engaging in retention slots, the forward projecting collars of end wall projecting into the ends of the terminal cavities and engaging the cable seals to assure that the cable seals as well as the terminals axe properly located in the terminal cavities.

10. The electrical plug receptacle connector as defined in claim 9 wherein the EMI shield engages over the collar and the annular hood of the connector body and wherein a gasket is attached to the front wall of the connector body using the integral studs of the front wall which are headed over to keep the gasket in place.

11. An electrical plug connector as defined in claim 1, wherein said plug connector has received a mating electrical receptacle connector for a plurality of electrical leads that are attached to an internal component of an electrical device inside a casing and threaded through a hole in the casing, the plurality of electrical leads having a plurality of receptacle terminal respectively, the electrical receptacle connector comprising:

a receptacle that is adapted to mount over the hole in the casing and be fastened thereto, the receptacle having a chamber including an inlet at one end that is aligned with the hole in casing and an outlet at the other end, a receptacle terminal holder and a plurality of receptacle terminals retained thereby being insertable into the chamber through the outlet and retained in the chamber, a receptacle terminal housing being insertable into the internal chamber via the outlet and having a flange that is retained in the outlet, and the flange having a plurality of spa holes extending through the flange, each hole receiving one of the plurality of receptacle terminals, respectively.

12. The electrical plug connector as defined in claim 11 wherein the flange includes a stop to locate the terminal housing with respect to the receptacle in a longitudinal direction of the receptacle terminals and an integral shroud that extends outwardly of the outlet whereby the electrical receptacle connector is adapted to receive a mating plug connector.

13. An electrical plug connector as defined in claim 1, wherein said plug connector has received a mating electrical receptacle connector for a plurality of electrical leads that are attached to an internal component of an electrical device inside a casing and threaded through a hole in the casing, the plurality of electrical leads having a plurality of receptacle terminals respectively, the electrical receptacle connector comprising:

a receptacle that is adapted to mount over the hole in the casing and fastened thereto, a receptacle terminal holder and a receptacle terminal housing, both of which are made of electrical insulation material, the receptacle having a chamber including an inlet at one end that is aligned with the hole in casing and an outlet at the other end, the holder having a plurality of laterally spaced terminal retainers retaining the plurality of receptacle terminals, respectively, the holder and the plurality of receptacle terminals retained thereby being insertable into the chamber through the outlet and retained in the chamber to minimize the length of leads fed back into the chamber, the receptacle terminal housing being insertable into the internal chamber via the outlet and having a flange that is disposed in the outlet, the flange having a plurality of spaced holes extending through the flange, each hole receiving one of the plurality of receptacle terminals, respectively, and the flange including a stop to locate the receptacle terminal housing with respect to the receptacle in a longitudinal direction of the receptacle this, and an integral shroud that extends outwardly of the outlet whereby the electrical receptacle connector is adapted to receive a mating plus connector.

14. An electrical plug connector as defined in claim 13, wherein the outlet of the chamber is a stepped outlet having an inner portion and a larger intermediate portion of the stepped outlet, wherein the terminal holder is retained in the inner portion of the stepped outlet, wherein the flange is retained in the larger intermediate portion of the stepped outlet and wherein the stop of the flange comprises a plurality of stop tabs that extend through spaces of the holder to engage an internal shoulder of the receptacle.

15. An electrical plug connector as defined in claim 14, wherein the end receptacle terminals are barrel type terminals that have a barrel shaped contact at one end and an opposite end that is attached to one of the electrical leads, wherein the opposite end includes an end collar, and wherein the laterally spaced terminal retainers retain the plurality of receptacle terminals respectively, by clips of holder with end collars cooperating with the clips and the retainers for axial retention of the receptacle terminals.

16. An electrical plug connector as defined in claim 15, wherein the opposite ends of the end receptacle terminals include an annuls recess which is spaced inwardly of the collar toward the contact and which receives an elastomeric O-ling seal, and wherein the flange has an integral terminal collar extending from an inner side of the flange for each hole that cooperates with the O-ring seal of the associated receptacle terminal to seal the passage through the hole.

17. An electrical plug connector as defined in claim 16, wherein the receptacle is a right angled metal receptacle and the stepped outlet is perpendicular to the inlet, wherein the receptacle terminal holder has a plurality of press ta, each of which is located between a pair of receptacle terminal retainers, and wherein the press tabs are received in retaining blots of the receptacle.

18. The electrical plug connector as defined in claim 1 wherein the forward TPA portion includes a forward projecting hood that fits over the rearward end of the connector body.

19. The electrical plug connector as defined in claim 18 wherein the hood has a plurality of loading slots that align with lead slots and retention slots, respectively.

20. The electrical plug connector as defined in claim 18 wherein a cable seal is disposed on each lead in a position behind the terminal.

21. The electrical plug connector as defined in claim 20 wherein the hood is configured to engage the cable seals, so as to assure that the cable seals and the terminals are properly located in the terminal cavities.

22. The electrical plug connector as defined in claim 1 wherein the rearward dress portion is a closed collar.

23. The electrical plug connector as defined in claim 22 wherein the rearward wire dress portion is connected together with the forward TPA portion by a transition.

24. The electrical plug connector as defined in claim 23 wherein the top of the transition is open.

25. A female terminal comprising a contact barrel at one end and an attachment portion at the opposite end, the contact barrel being a split bawl with the seam of the barrel being formed by interlocking tabs and slots to guard against the barrel seam opening up at prolonged use, the front of contact barrel having two diametrically opposed wings that extend outwardly of the contact barrel, wherein the female terminal is received by a cylindrical terminal cavity formed by a cylindrical portion of a connector body wherein a cable seal is disposed on a lead that is attached to attachment portion of the terminal, and wherein the terminal cavity is adapt to cooperate with a TPA/wire dress feature so as to facilitate proper alignment of the cable seal and the terminal within the terminal cavity.

26. The female terminal as defined in claim 25 wherein the terminal is a female terminal that includes a female contact insert that comprises a plurality of contact wires inside a support sleeve with the ends of the contact wires wrapped around the ends of the support sleeve.

27. A method of assembling an electrical plug connector mated with an electrical receptacle connector for a plurality of electrical leads that are attached to an internal component of an electrical device inside a casing and threaded through a hole in the casing, the plurality of electrical wires having a plurality of terminals respectively, comprising the steps of:

providing an electrical plug connector for a plurality of electrical leads comprising, the plug connector comprising a plurality of terminals each attached to one of the plurality of electrical leads, a connector body housing the plurality of terminals, a terminal position assurance(TPA)/wire dress feature for the plurality of terminals and electrical leads, and an electromagnetic interference (EMI) shield;

providing a receptacle having a chamber including an inlet at one end that is aligned with the hole in casing and an outlet at the other end, mounting the receptacle over the hole in the casing and fastening the receptacle thereto so that the plurality of electrical leads end through the chamber and out of the outlet;

providing a receptacle terminal holder having a plurality of laterally spaced receptacle terminal retainers and a receptacle terminal housing having a flange with a plurality of spaced holes extending there through, both the receptacle terminal holder and the receptacle terminal housing being made of electrical insulation material;

retaining the plurality of receptacle terminals, respectively in the plurality of laterally spaced receptacle terminal retainers of the receptacle terminal holder respectively;

inserting the receptacle terminal holder into the chamber via the outlet and retaining the receptacle terminal holder in the chamber;

inserting the receptacle terminal housing into the internal chamber via the outlet with each hole of the flange receiving one of the plurality of receptacle terminals, respectively, and retaining the terminal housing in the chamber; and mating the terminals of the electrical plug connector the receptacle terminals of the electrical receptacle connector.

* * * * *